US005997087A

United States Patent [19]

Stumpf

[11] Patent Number: 5,997,087

[45] Date of Patent: Dec. 7, 1999

[54] CHAIR TILT MECHANISM

[75] Inventor: William S. Stumpf, Waterloo, Canada

[73] Assignee: Northfield Metal Products Ltd., Waterloo, Canada

[21] Appl. No.: 09/143,130

[22] Filed: Aug. 28, 1998

Related U.S. Application Data

[63] Continuation-in-part of application No. 08/922,138, Aug. 29, 1997.

[51] Int. Cl.[6] ..... A47C 1/02; A47C 7/60

[52] U.S. Cl. ..... 297/327; 297/302.7; 297/301.7

[58] Field of Search ..... 297/325, 328, 297/327, 302.1, 300.8, 301.7, 302.7

[56] References Cited

U.S. PATENT DOCUMENTS

| | | | |
|---|---|---|---|
| 3,480,249 | 11/1969 | Lie | 297/328 |
| 3,975,050 | 8/1976 | McKee | 297/328 |
| 4,101,167 | 7/1978 | Örnberg | 297/328 |
| 4,384,741 | 5/1983 | Flum et al. . | |
| 4,555,085 | 11/1985 | Bauer et al. . | |
| 4,664,445 | 5/1987 | Groseth . | |
| 4,892,354 | 1/1990 | Estkowski et al. . | |
| 4,911,501 | 3/1990 | Decker et al. | 297/300.8 |
| 4,938,531 | 7/1990 | Fogarassy et al. . | |
| 4,948,198 | 8/1990 | Grossman et al. . | |
| 5,018,787 | 5/1991 | Estkowski et al. . | |
| 5,066,069 | 11/1991 | DeGelder . | |
| 5,080,434 | 1/1992 | Locher | 297/300.8 |
| 5,259,663 | 11/1993 | Ambasz | 297/302 |
| 5,417,474 | 5/1995 | Golynsky . | |
| 5,423,595 | 6/1995 | Hancock | 297/374 |
| 5,577,807 | 11/1996 | Hodge et al. | 297/300.8 |
| 5,683,139 | 11/1997 | Golynsky et al. | 297/302.3 |
| 5,762,399 | 6/1998 | Liu | 297/302.7 |

*Primary Examiner*—Anthony D. Barfield
*Attorney, Agent, or Firm*—Wood, Herron, & Evans, LLP

[57] ABSTRACT

A chair seat tilt lock comprises a slider riding along a track on the seat and an abutment extending from chair seat post. The slider is spring biased into registration with the abutment to block the chair against tilting and may also be moved away from the abutment so that the chair is then free to tilt. The slider is mover by a lever arm connected to the slider by a co-axial cable with an enlargement at the end of the inner cable which allows the cable to be releasably press fit into a skeleton key-shaped passageway through the slider.

17 Claims, 5 Drawing Sheets

CHAIR TILT MECHANISM

CROSS REFERENCE RELATED APPLICATION

This application is a continuation-in-part of application Ser. No. 08/922,138 filed Aug. 29, 1997.

FIELD OF THE INVENTION

This invention relates to a chair tilt lock and to a chair comprising such a lock.

BACKGROUND OF THE INVENTION

It is typical in office chairs for the seat to tilt rearwardly as an occupant leans back in the seat. Other chairs, such as chairs for typing, are designed so that the seat tilts forwardly when an occupant leans forward in a chair. However, sometimes the occupant does not wish the seat to tilt when leaning forwardly or rearwardly. To accommodate such an occupant preference, chairs have been designed with tilt locks.

U.S. Pat. No. 4,555,085 issued Nov. 26, 1985 to Bauer et al. discloses a chair seat tilt lock. A horizontal slider slides between a position whereat a bolt extending through the slider blocks the base plate of the seat and, therefore, prevents the seat from tilting and another position whereat the bolt is registered with an opening through the base plate. The slider is moved by an operating arm which is secured to it.

The subject invention seeks to provide an improved chair seat tilt lock.

SUMMARY OF THE INVENTION

According to thc present invention, there is provided a chair tilt lock, comprising: a chair seat post support; a chair seat base tiltably mounted to said chair seat post support so that a distal portion of said chair seat base may tilt toward and away from said chair seat post support; an abutment rigidly extending from one of said chair seat post support and said distal portion of said chair seat base; a track depending from said other of said chair seat post support and said chair seat base; a slider riding along said track and therefore slidably mounted to the other of said chair seat post support and said distal portion of said chair seat base for sliding between a first position whereat said slider is in blocking relation with said abutment so that said slider blocks said distal portion of said chair seat base from tilting toward said chair seat post support and a second position whereat said slider is not in blocking relation with said abutment so that said slider does not block said distal portion of said chair seat base from pivoting toward said chair seat post support; and an actuator for sliding said slider between said first position and said second position, said actuator comprising a user actuator mounted to said one of said chair seat post support and said chair seat base and a link comprising a co-axial cable attached to said user actuator and attached to said slider such that actuation of said user actuator in one sense causes said slider to slide from said first position to said second position.

BRIEF DESCRIPTION OF THE DRAWINGS

In the figures which illustrate example embodiments of the invention.

DETAILED DESCRIPTION OF THE PREFERRED EMBODIMENTS

Figure 1:
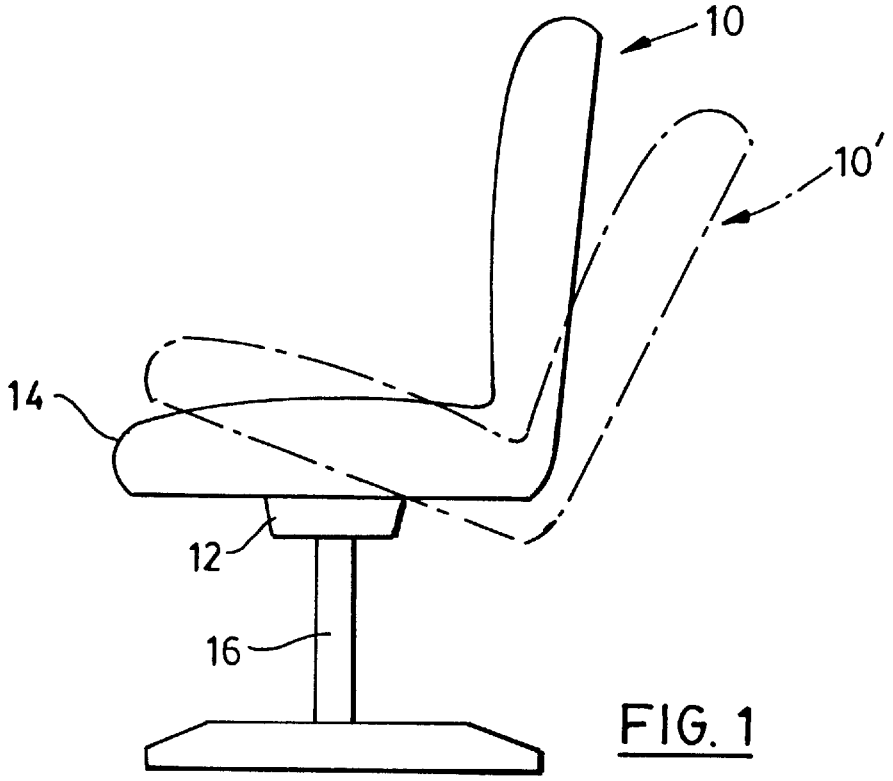
FIG. 1 is a side view of a chair embodying a tilt lock made in accordance with this invention.

Turning to FIG. 1, a chair 10 has a tilt lock mechanism 12 joining the chair seat 14 to the chair seat post 16. With the chair tilt lock in an unlocked position, the chair 10 may tilt from a solid line position shown in FIG. 1 to position 10' shown in FIG. 1 in ghost.

Figure 2:
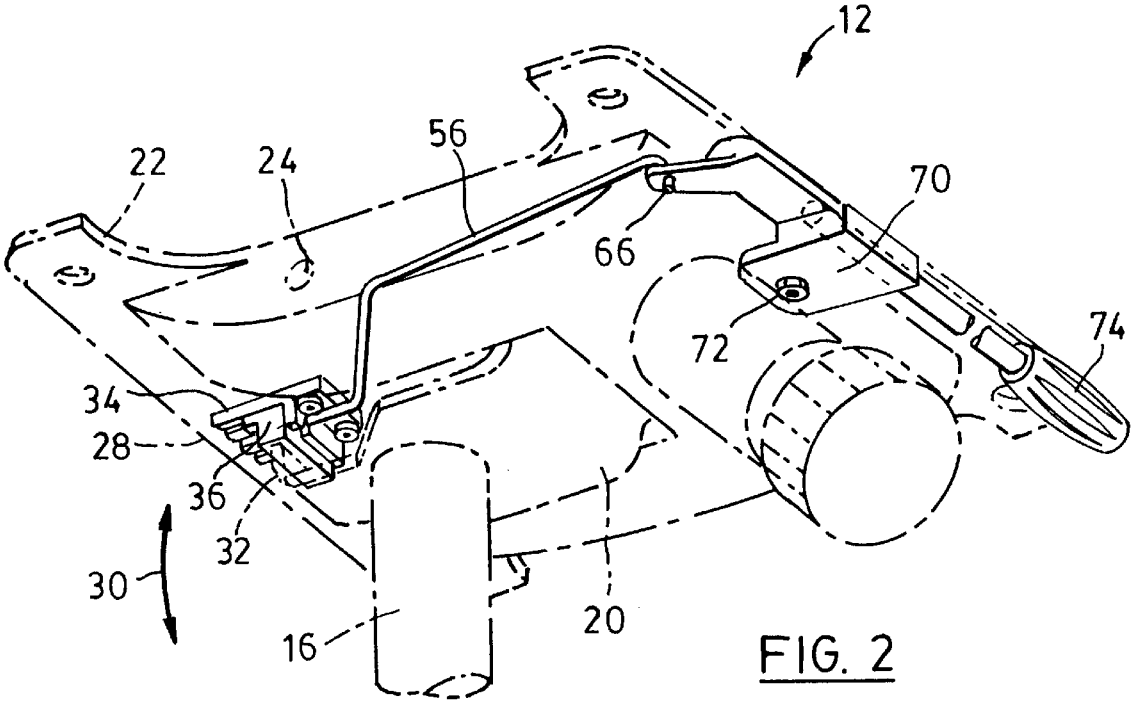
FIG. 2 is a perspective view of a tilt lock made in accordance with one embodiment of this invention shown in a locked position.

Turning to FIG. 2, a tilt lock for the chair comprises a chair seat post support 20 supporting seat post 16 and a chair seat base 22 to which the seat of the chair is affixed. The chair seat base 22 is pivotally mounted to the chair seat post support 20 by pivot 24 so that distal portion 28 of the chair seat base may tilt in direction 30. An abutment 32 rigidly extends from the chair seat post support 20. A track 34 is mounted to the chair seat base and a slider 36 is slidably received by track 34.

Figure 5:
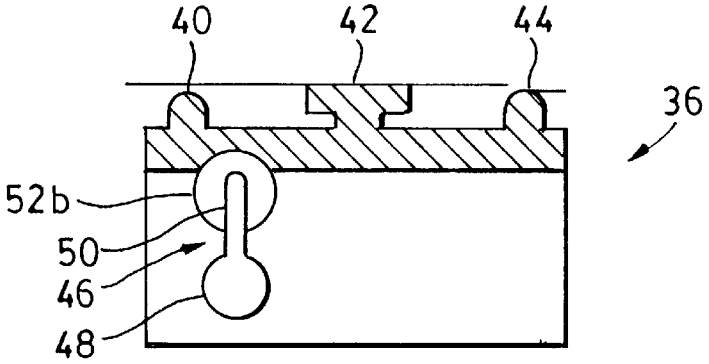
FIG. 5 is a cross-sectional view of a portion of FIG. 4 along the lines V—V.
Figure 4:
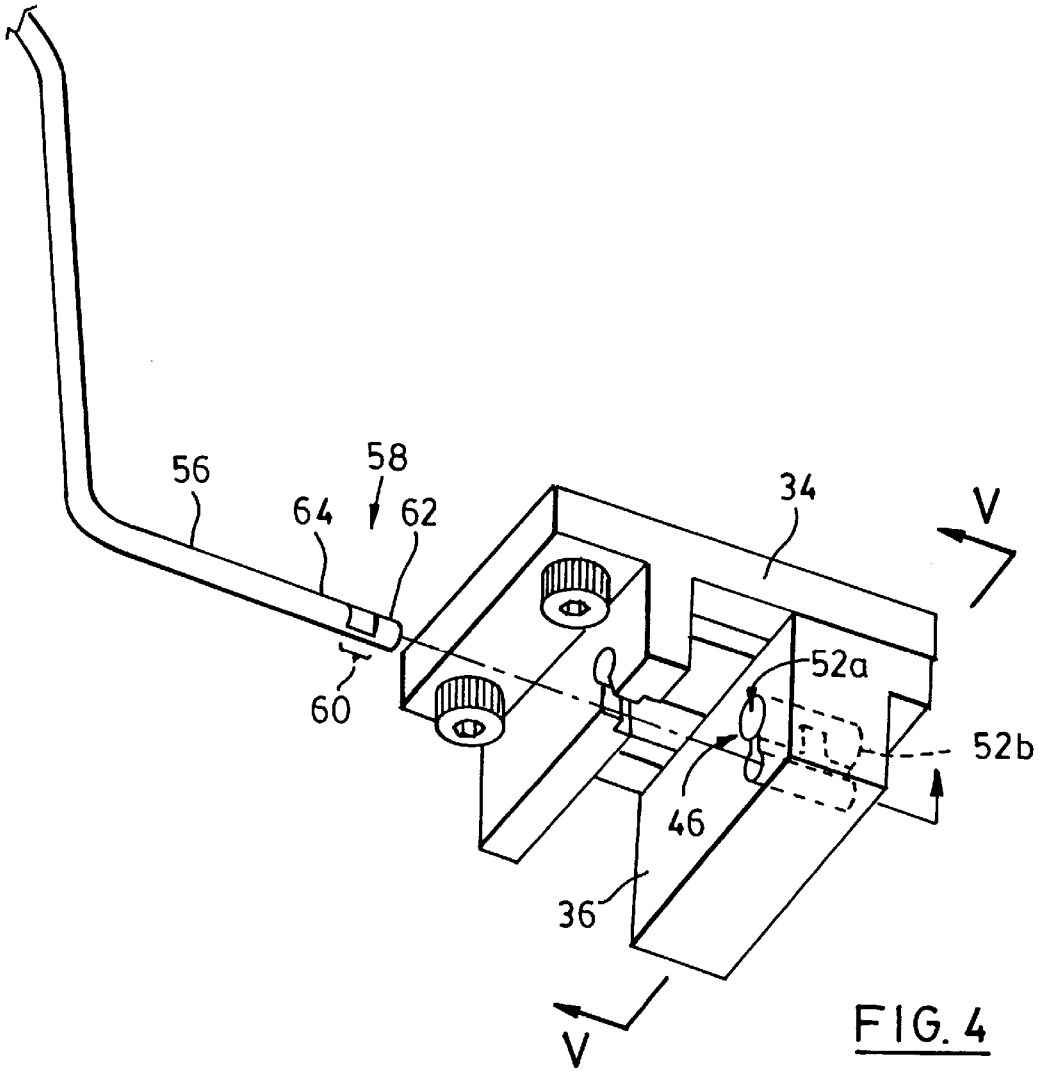
FIG. 4 is a perspective view of a portion of FIG. 2.

The slider is detailed in FIGS. 4 and 5. Turning to these figures, the slider 36 has three protrusions 40, 42 and 44. These protrusions are designed to ride in slots of the track 34. Protrusion 42 has a T-shaped cross-section which slides in a slot of similar cross-section thereby retaining the slider in association with the track. The slider has a skeleton key-shaped passageway 46 extending therethrough with an enlarged portion 48 and a narrow portion 50. As well, the slider has two countersunk bores 52*a*, 52*b* in either face which extend part way through the slider from the faces thereof at the narrow portion 50 of the skeleton key-shaped passageway.

Referencing FIGS. 2 and 4, a link arm 56 has an end portion 58 with a narrow section 60 between two spaced enlargements 62, 64. This allows the end portion 58 of the link arm 56 to be attached to the slider, as follows. The end portion 58 is slid along portion 48 of the skeleton key-shaped passageway 46 of the slider until the enlarged portions 62, 64 are aligned with either one of the countersunk bores 52*a*, 52*b* of the slider. Next the end portion 58 of the link arm is pushed so that its narrow section 60 enters the narrow portion 50 of the skeleton key-shaped passageway. The width of the narrow portion and narrow section are chosen to provide an interference fit so that with the end portion 58 of the link arm so positioned, it is retained within the slider 36.

It will be appreciated that this connection between the link arm and slider is releasable by pulling the link arm into the larger diameter opening 48 (FIG. 4) of the skeleton key-shaped passageway of the slider. This facilitates replacement of the slider or link arm should this become necessary.

Figure 3:
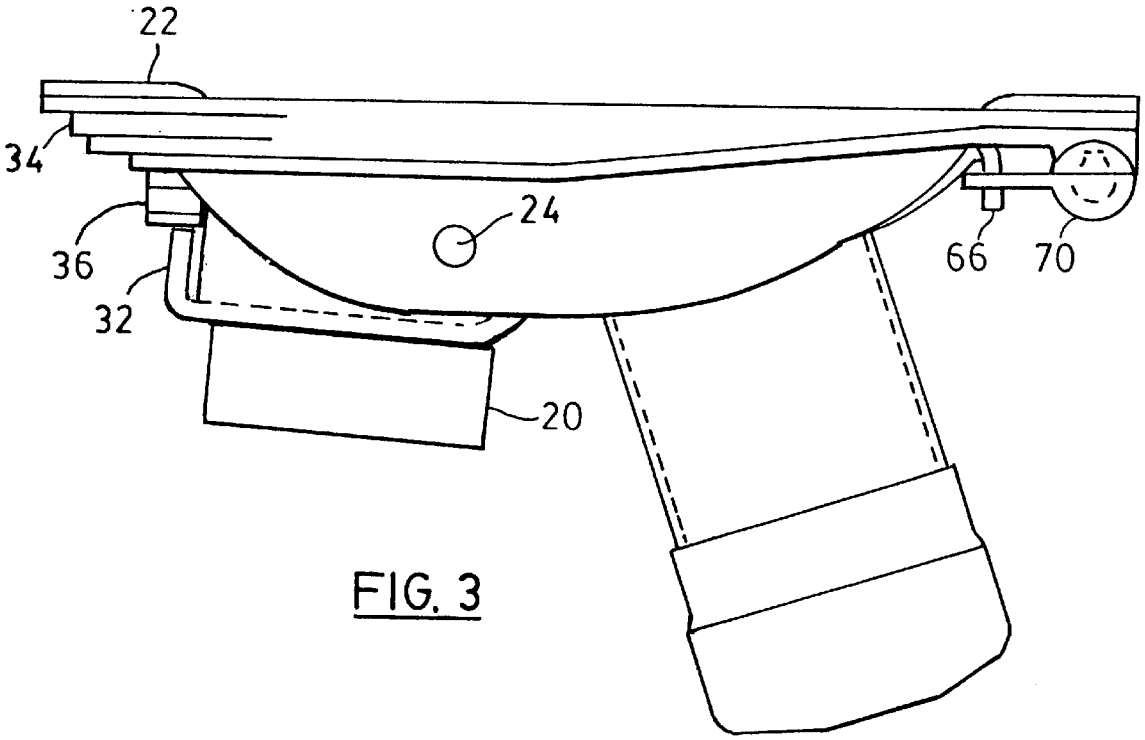
FIG. 3 is a side view of FIG. 2.

Returning to FIGS. 2 and 3, the link arm 36 terminates at its other end in a finger 66 which is received within an opening of a lever arm 70 so as to pivotally mount the link arm to the lever arm. The lever arm 70 is pivotally mounted by pivot 72 to the chair seat base 22. A handle 74 is attached to the lever arm.

With the lever arm 70 in the position shown in FIG. 2, the slider 36 is registered with the abutment 32 of the chair seat post support 20. In this position, the distal end 28 of the chair seat base is blocked from tilting in direction 30.

Figure 7:
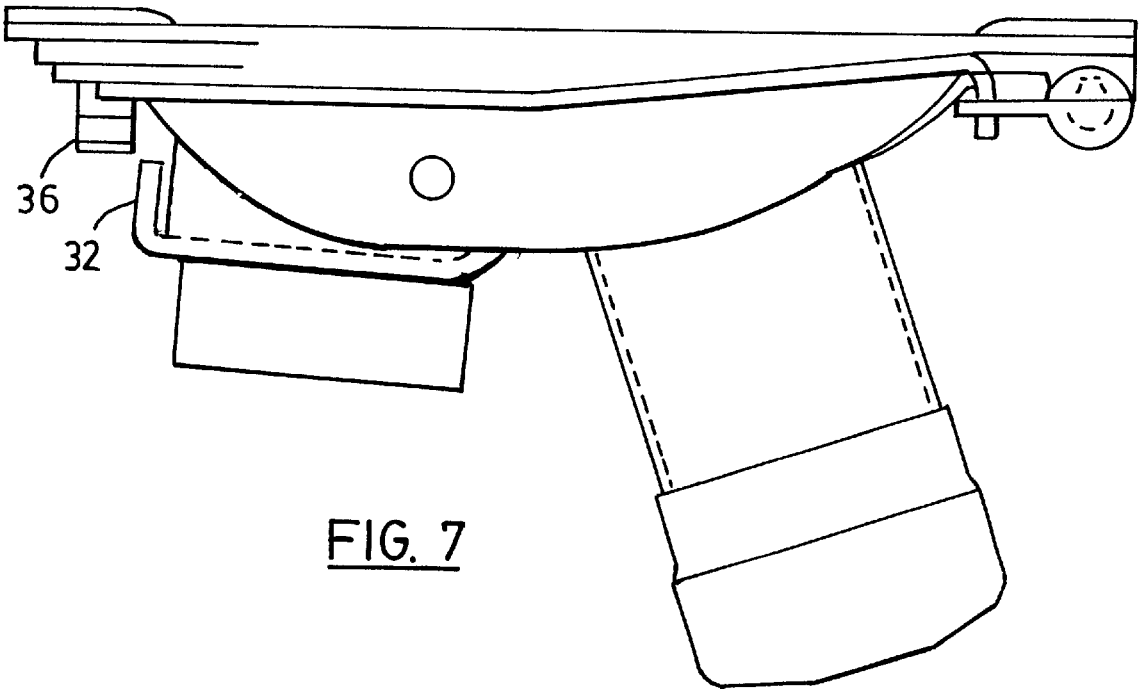
FIG. 7 is a side view of FIG. 6.
Figure 6:
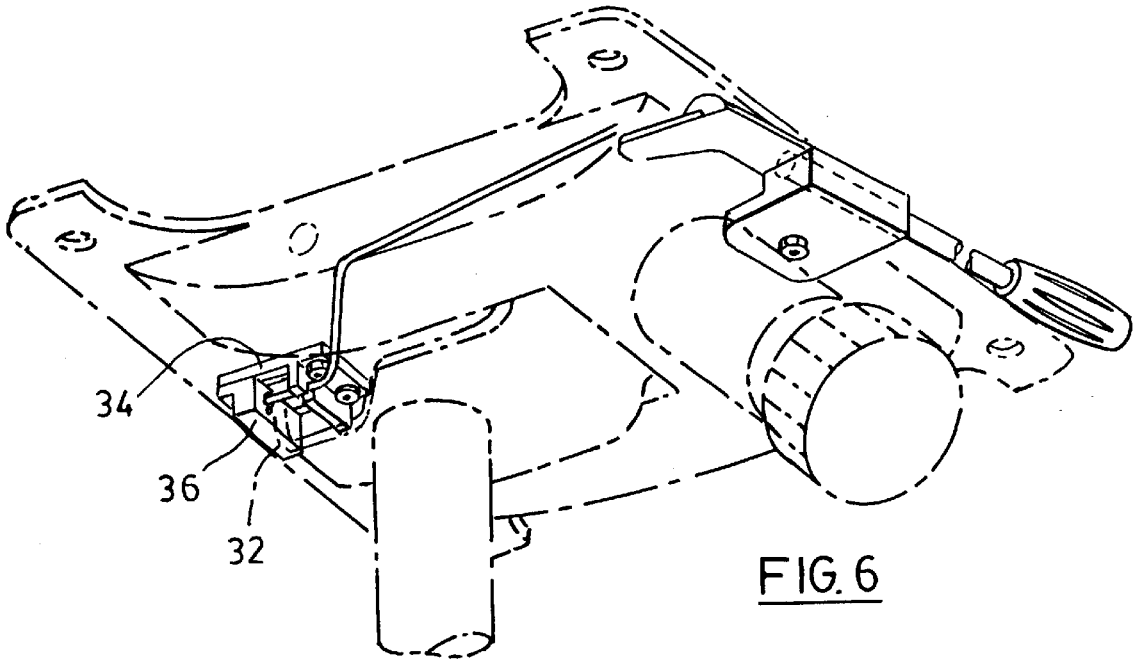
FIG. 6 is a perspective view of the tilt lock shown in an unlocked position.

An occupant of the chair may unlock the tilt lock by grasping handle 74 of lever arm 70 and pivoting the lever arm about pivot 72. This causes the link arm to push slider 36 along track 34. The result is shown in FIGS. 6 and 7. With the slider in the position shown in FIGS. 6 and 7, it will be appreciated that it is no longer blocked by abutment 22. Accordingly, the chair seat is no longer locked against the tilting.

It will be appreciated from the foregoing that the lever arm and link arm act as an actuator for the slider.

Figure 10:
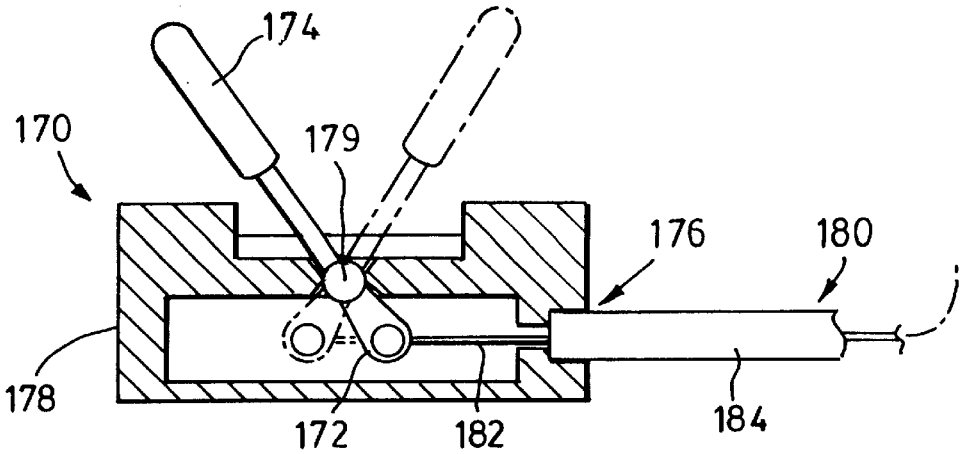
FIG. 10 is a cross-sectional view of a portion of FIG. 9.
Figure 8:
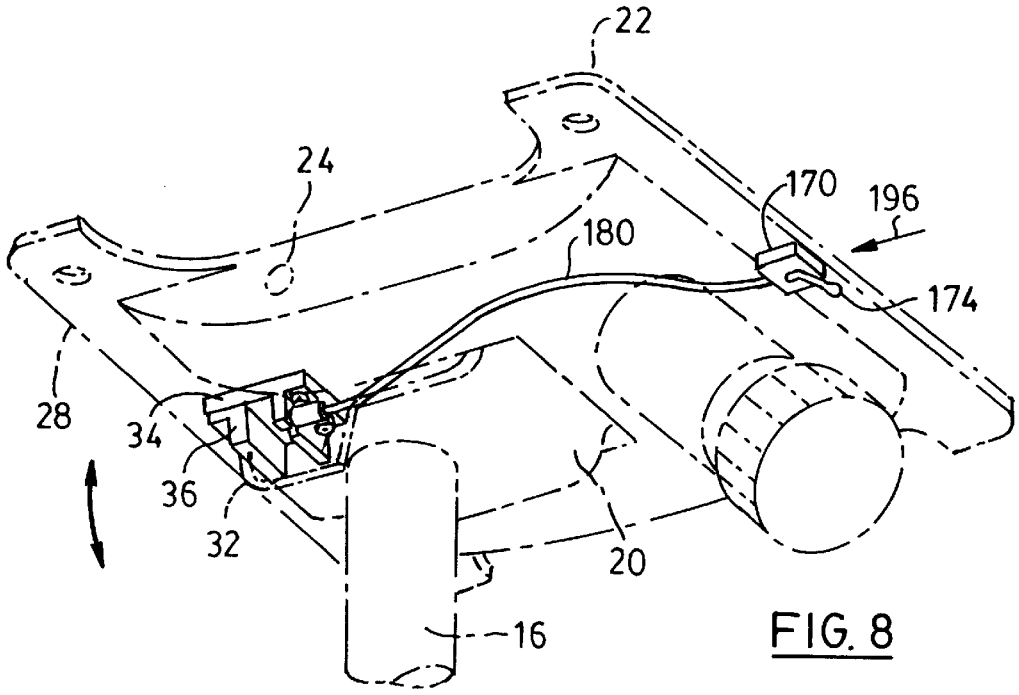
FIG. 8 is a perspective view of a tilt lock made in accordance with another embodiment of this invention shown in a locked position.
Figure 9:
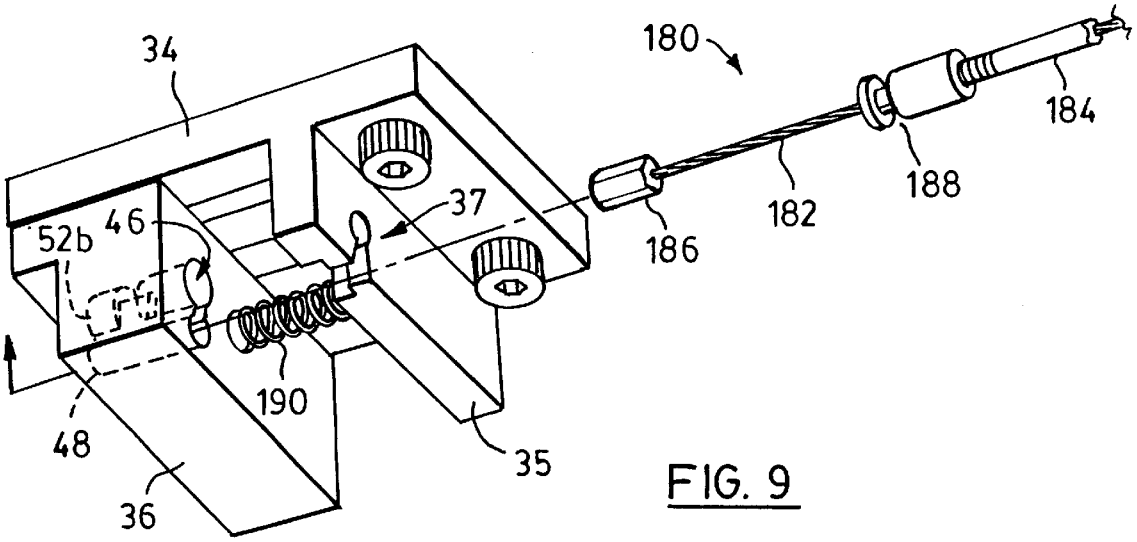
FIG. 9 is a perspective view of a portion of FIG. 8.

Another tilt lock made in accordance with this invention is illustrated in FIGS. 8 and 10. Turning to these figures, wherein like parts have been given like reference numerals, a link between an user actuator 170 and the slider 36 of tilt lock mechanism 112 comprises a co-axial cable 180 with an inner cable 182 and an outer sheath 184. The inner cable 182 terminates in an enlarged end 186 which, referencing FIG. 5 along with FIG. 9, may be passed through enlarged portion 48 of skeleton key-shaped passageway 46 and then pushed into end bore 52*b* such that the inner cable 182 is received by narrow portion 50 of passageway 46. As well, notched end 188 of outer sheath 184 is received by keyway 37 of flange 35 depending from track 34 so that the sheath bears against flange 35 when the inner cable is retracted. As illustrated in FIG. 9, a spring 190 biases the slider 36 toward the end of track 34.

The other end of the co-axial cable 180 is received by user actuator 170, as illustrated in FIG. 10. The inner wire 182 is joined to the base 172 of lever 174 and the outer sheath 184 is received within a notch 176 of housing 178 of the user actuator. The lever 174 is medially pivotally mounted to the housing by pivot 179.

With the lever 174 in the position shown in FIG. 8, the slider 36 is at the end of track 34 and registered with the abutment 32 of the chair seat post support 20. In this position, the distal end 28 of the chair seat base is blocked from tilting in direction. 30. When the lever 174 is moved in the direction indicated by arrow 196, the slider 36 is pulled against the force of spring 190 out of registration with abutment 32. Thereafter the chair may be tilted even when lever 174 is released. However, after release of lever 174, the slider will be biased against tie side of abutment 32 and will once again snap under the abutment when the chair is returned to its non-tilted position of FIG. 8.

Lever 174 is designed for finger actuation. In its place, a handle 74 could be provided under the seat which terminates an arm pivoted to the seat base 22 at one end. In this case, the medial portion of the arm would be attached to the inner wire of the coaxial cable and a bifurcated abutment would be provided on the chair seat base proximate the arm to support the sheath 184 while allowing the inner wire to extend therepast.

While the chair illustrated in FIG. 1 is designed to tilt backwardly from a horizontal position, it could equally be designed to tilt forwardly from a horizontal position.

Other modifications will be apparent to those skilled in the art and, therefore, the invention is defined in the claims.

What is claimed is:

1. A chair tilt lock, comprising:

a chair seat post support;

a chair seat base tiltably mounted to said chair seat post support so that a distal portion of said chair seat base may tilt toward and away from said chair seat post support;

an abutment rigidly extending from one of said chair seat post support and said distal portion of said chair seat base;

a track depending from said other of said chair seat post support and said chair seat base;

a slider riding along said track and therefore slidably mounted to the other of said chair seat post support and said distal portion of said chair seat base for sliding between a first position whereat said slider is in blocking relation with said abutment so that said slider blocks said distal portion of said chair seat base from tilting toward said chair seat post support and a second position whereat said slider is not in blocking relation with said abutment so that said slider does not block said distal portion of said chair seat base from pivoting toward said chair seat post support; and an actuator for sliding said slider between said first position and said second position, said actuator comprising a user actuator mounted to said one of said chair seat post support and said chair seat base and a link comprising a co-axial cable attached to said user actuator and attached to said slider such that actuation of said user actuator in one sense causes said slider to slide from said first position to said second position.

2. The lock of claim 1 including biasing means for biasing said slider to said first position such that actuation of said user actuator in a sense opposite said one sense causes said slider to slide from said second position to first second position.

3. The lock of claim 1 including a spring for biasing said slider to said first position such that actuation of said user actuator in a sense opposite said one sense causes said slider to slide from said second position to first second position.

4. The lock of claim 3 wherein an inner wire of said co-axial cable comprises an enlarged end and wherein said slider comprises a skeleton key-hole shaped passageway with an enlarged portion sized for reception of said enlarged end and a narrow portion sized for reception of said inner wire and not for reception of said enlarged end such that said inner wire may be selectively detached from said slider.

5. The lock of claim 3 wherein said user actuator comprises a lever having one end attached to an inner wire of said co-axial cable and having a housing abutting an outer sheath of said co-axial cable.

6. The lock of claim 4 wherein said one of said chair seat post support and said chair seat base comprises said chair seat post support and said other of said chair seat post support and said chair seat base comprises said chair seat base.

7. The lock of claim 4 wherein said track comprises a guideway and said slider comprises a mating guided portion.

8. The lock of claim 7 wherein said chair seat base tilts toward and away from said chair seat post support along a path and wherein said guideway extends transversely of said path.

9. The lock of claim 8 wherein said user actuator comprises a lever having one end attached to said inner wire of said co-axial cable and having a housing abutting an outer sheath of said co-axial cable.

10. A chair, comprising:

a chair seat post;

a chair seat tiltably mounted to said chair seat post;

an abutment rigidly fixed to one of said chair seat post and said chair seat;

a track depending from sail other of said chair seat post and said chair seat;

a slider riding along said trick and therefore slidably mounted to the other of said chair seat post and said seat, said slider slidable between a first position whereat said slider is in registration with said abutment so that said slider blocks said chair seat from tilting and a second position whereat said slider is not in registration with said abutment so that said slider does not block said chair seat from tilting; and an actuator for sliding said slider between said first position and said second position, said actuator comprising a user actuator mounted to said one of said chair seat post support and said seat and a link comprising a co-axial cable attached to said user actuator and attached to said slider such that actuating said user actuator in one sense causes said slider to slide from said first position to said second position.

11. The lock of claim 10 including biasing means for biasing said slider to said first position such that actuating of said user actuator in a direction opposite said one direction causes said slider to slide from said second position to first second position.

12. The lock of claim 7 including a spring for biasing said slider to said first position such that actuating said sense in a direction opposite said one sense causes said slider to slide from said second position to first second position.

13. The lock of claim 10 wherein an inner wire of said co-axial cable comprises an enlarged end and wherein said slider comprises a skeleton key-hole shaped passageway with an enlarged portion sized for reception of said enlarged end and a narrow portion sized for reception of said inner wire and not for reception of said enlarged end such that said inner wire may be selectively detached from said slider.

14. The lock of claim 13 wherein said one of said chair seat post and said chair seat comprises said chair seat post and said other of said chair seat post and said chair seat comprises said chair seat.

15. The lock of claim 14 wherein said track comprises a guideway and said slider comprises a mating guided portion.

16. The lock of claim 15 wherein said chair seat tilts downwardly along a path and wherein said guideway extends transversely of said path.

17. The lock of claim 10 wherein said user actuator comprises a lever having one end attached to an inner wire of said co-axial cable and having a housing abutting an outer sheath of said co-axial cable.

* * * * *

UNITED STATES PATENT AND TRADEMARK OFFICE

CERTIFICATE OF CORRECTION

PATENT NO. : 5,997,087
DATED : December 7, 1999
INVENTOR(S) : William S. Stumpf

It is certified that error appears in the above-identified patent and that said Letters Patent is hereby corrected as shown below:

Column 4,
Line 66, "from sail" should be ---from said---.

Column 5,
Line 1, "said trick" should be ---said track---.
Line 22, "claim 7" should be ---claim 11---.

Signed and Sealed this

Third Day of July, 2001

*Attest:*

Nicholas P. Godici

*Attesting Officer*

NICHOLAS P. GODICI
*Acting Director of the United States Patent and Trademark Office*